US006966451B2

(12) United States Patent
Weiss et al.

(10) Patent No.: US 6,966,451 B2
(45) Date of Patent: Nov. 22, 2005

(54) SPINNING EYE AND MOUTH CHARACTER CANDY DISPENSER

(76) Inventors: Gary Weiss, 1713 Artesia Blvd. Suite A, Manhattan Beach, CA (US) 90266; Daniel G. Hart, 1713 Artesia Blvd. Suite A, Manhattan Beach, CA (US) 90266

( * ) Notice: Subject to any disclaimer, the term of this patent is extended or adjusted under 35 U.S.C. 154(b) by 180 days.

(21) Appl. No.: 10/632,594

(22) Filed: Aug. 1, 2003

(65) Prior Publication Data

US 2005/0035132 A1 Feb. 17, 2005

(51) Int. Cl.[7] ..... A24F 15/04
(52) U.S. Cl. ..... 221/24; 221/265
(58) Field of Search ..... 221/24, 263, 265, 221/277, 246

(56) References Cited

U.S. PATENT DOCUMENTS

| | | | | |
|---|---|---|---|---|
| 2,177,863 A | | 10/1939 | Cadden et al. | 206/42 |
| 3,099,365 A | | 7/1963 | Johnson | 221/263 |
| 3,586,159 A | | 6/1971 | Kirchner | 206/42 |
| 3,638,830 A | * | 2/1972 | Belokin, Jr. | 221/246 |
| 5,356,035 A | | 10/1994 | Shlopak et al. | 222/78 |
| 5,632,377 A | | 5/1997 | Ferrero | 206/457 |
| 6,026,546 A | | 2/2000 | Lund et al. | 24/431 |
| 6,267,639 B1 | | 7/2001 | Menow et al. | 446/81 |
| 6,299,015 B1 | | 10/2001 | Hasan et al. | 221/24 |
| 6,368,646 B1 | | 4/2002 | Monow et al. | 426/115 |
| 6,488,187 B2 | | 12/2002 | Sheffler et al. | 222/480 |
| 6,530,499 B1 | * | 3/2003 | Coleman et al. | 221/24 |
| 6,595,385 B2 | * | 7/2003 | Nakamoto et al. | 221/24 |

* cited by examiner

*Primary Examiner*—Kenneth Noland
(74) *Attorney, Agent, or Firm*—Cislo & Thomas LLP

(57) ABSTRACT

Provided is a dispensing system, including a container configured with one or more apertures, and configured to house items, a faceplate configured with one or more dispensing apertures, rotationally coupled to the container, such that the items may be dispensed from the container, and one or more novelties coupled to the container, configured to move when the faceplate rotates with respect to the container.

11 Claims, 4 Drawing Sheets

SPINNING EYE AND MOUTH CHARACTER CANDY DISPENSER

BACKGROUND

There may be a demand for dispensers which serve as containers for small confections, and the like, that include features that may attract a purchaser. Such dispensers enable purchasers, such as children, to carry confections, including candy, chewing gum, and the like, under relatively sanitary conditions and to dispense such confections as desired without the danger of spilling and/or contaminating the entire quantity of confections.

Confection dispensers are generally well known in the art and come in a wide variety of shapes and sizes. A relatively high percentage of candy purchases may be made by, or at the insistence of, children. However, the typical child may have little, if any, brand loyalty, and thus candy manufacturers may have long relied on clever packaging in order to attract the purchaser's attention. One marketing approach may be to put the candy in an attractive candy dispenser designed to appeal to children and/or adults. For example, many members of the public can recall the very popular Pez® candy dispensers. Other candy packages may rely on the use of licensed cartoon characters, action figures, or even the name of a popular sports personality. Thus, it may be a commonly held belief that a candy container or dispenser that incorporates one or more novel or unique features is very likely to significantly increase the sales of that candy product. Therefore, there is a continuing need for novel candy containers and dispensers.

SUMMARY

Provided is a dispensing system, including a container configured with one or more apertures, and configured to house items, a faceplate configured with one or more dispensing apertures, rotationally coupled to the container, such that the items may be dispensed from the container, and one or more novelties coupled to the container, configured to move when the faceplate rotates with respect to the container.

DETAILED DESCRIPTION

The detailed description set forth below in connection with the appended drawings is intended as a description of exemplary embodiments and is not intended to represent the only forms in which the embodiments may be constructed and/or utilized. The description also sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
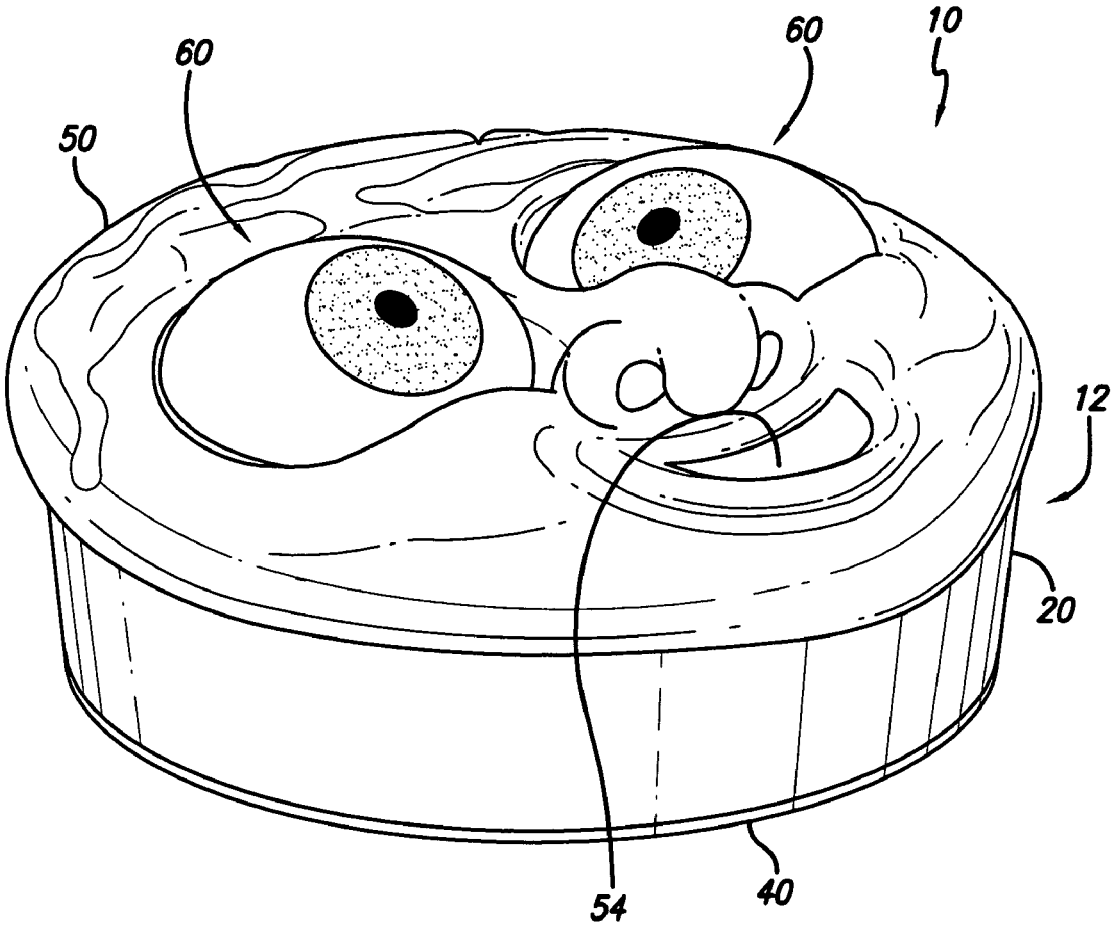
FIG. 1 is a perspective view of an exemplary embodiment according to the present invention.

A perspective view of an item dispensing system according to one embodiment of the present invention is shown in FIG. 1, generally at 10. System 10 typically includes a container 12 coupled to a faceplate 50 and including novelty portions 60 that may be configured to rotationally couple to container 12 or to faceplate 50. Container 12 is made up of a top housing 20 and a bottom housing 40 that are configured to couple to each other to form an enclosure therein. When faceplate 50 is rotated with respect to container 12, novelty portions 60 may be configured to rotate also. Faceplate 50 typically includes a dispensing aperture 54 that is configured to allow items to pass there through. System 10 is typically configured to hold confectionaries, such as candy or other items, and to selectively dispense those items, as desired.

Figure 2:
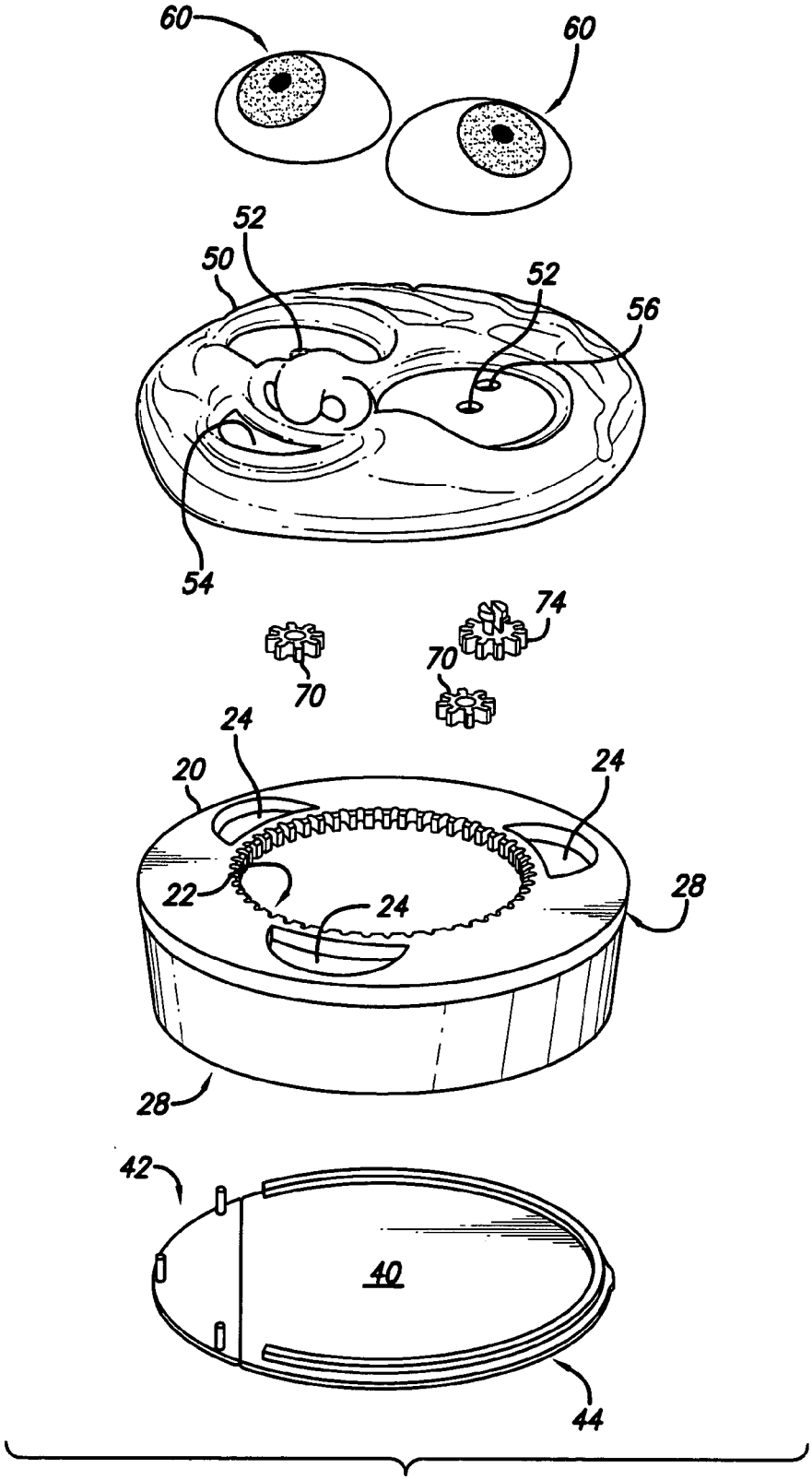
FIG. 2 is an exploded view of the exemplary embodiment of FIG. 1.
Figure 3:
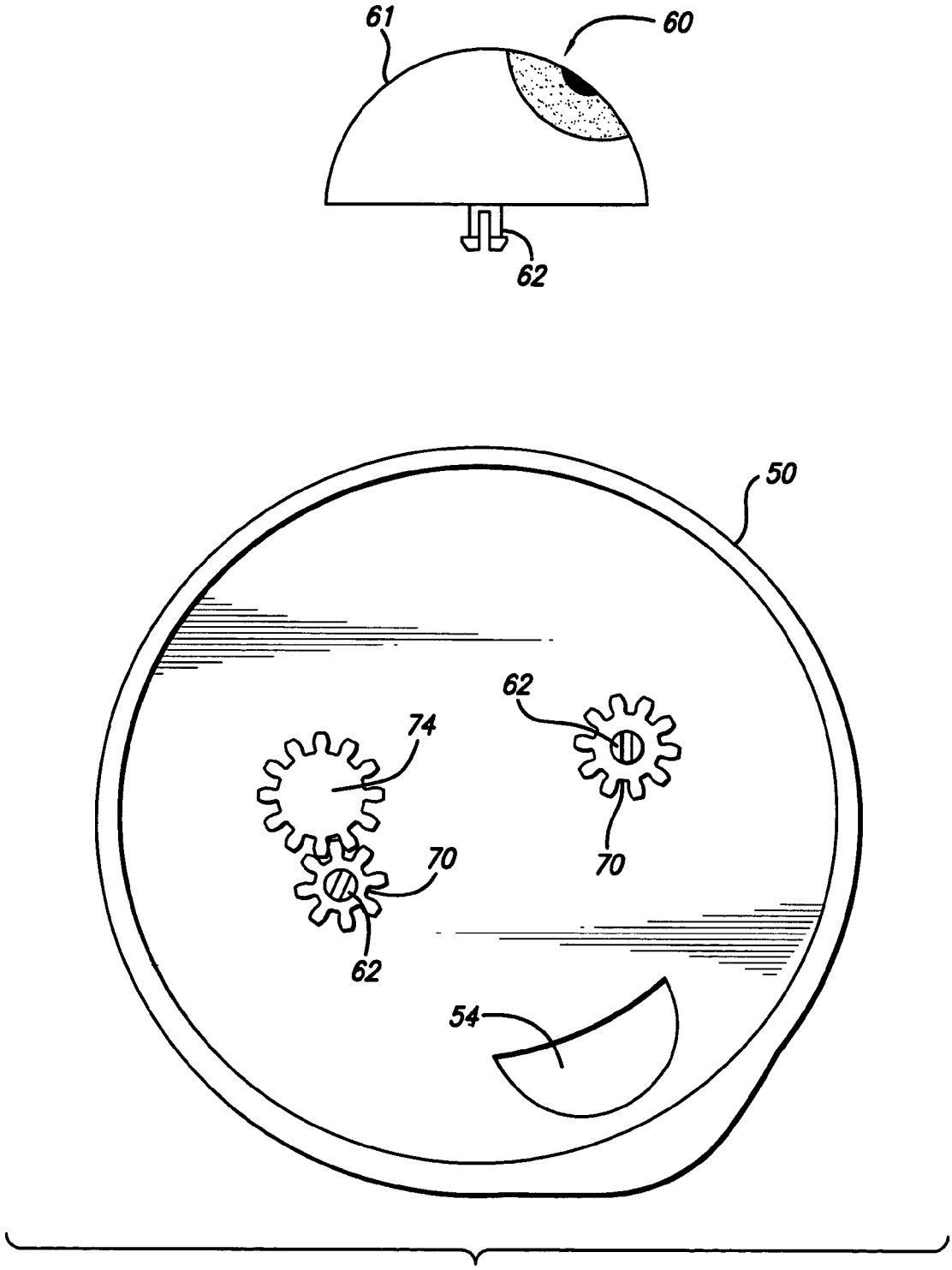
FIG. 3 is a further exploded view of the exemplary embodiment of FIG. 1.

FIGS. 2 and 3 are exploded views of item dispensing system 10 from FIG. 1. Novelty portions 60 may be configured to include a gearing coupling portion 62 that extends through novelty apertures 52 in faceplate 50. Faceplate 50 may be also configured with a dispensing aperture 54 that, when aligned with dispensing orifices 24 in top housing 20, will allow items such as candy to pass from the interior of container 12 through dispensing orifice 24 and dispensing aperture 54 to the exterior of the system. Faceplate 50 also typically includes a gearing coupling aperture 56 configured to allow rotational gearing 74 to couple to the faceplate to couple the two.

Gearing coupling portion 62 of rotating novelty portion 60 is configured to extend through novelty aperture 52 of faceplate 50 and coupled to novelty gearing 70. Novelty gearing 70 is configured to rotationally couple to top housing 20 such that when faceplate 50 is rotated with respect to container 12 or top housing 20, novelty portions 60 may also rotate.

Top housing 20 typically includes integrated gearing 22 that is configured to couple to rotational gearing 74 and novelty gearing 70, such that when faceplate 50 is rotated with respect to container 12 or top housing 20, novelty portions 60 will rotate. With rotational gearing 74 rotationally coupled to one of novelty portions 60, this configuration will allow novelty portions 60 to rotate in opposite directions, as desired.

Top housing 20 also typically includes one or more dispensing apertures 24 that when aligned with dispensing aperture 54 of faceplate 50 will allow items such as candy to pass from the interior of container 12 to the exterior of the system.

Therefore, when a user, such as a child, desires to dispense candy from the system, the user rotates the faceplate to align the apertures to allow candy to pass from the interior to the exterior of the system. When the user rotates the faceplate to align the apertures, the novelty portions also rotate, enhancing the play value and adding enjoyment for everyone.

Bottom housing 40 typically includes a top housing coupling structure 42 that is configured to couple to top housing 20 at a bottom housing coupling structure. It will be appreciated, however, that although an interference fit configuration is shown, other coupling structures may be utilized, as desired. It will be appreciated that although top housing 20 is shown with sides, bottom housing 40 may also include a vertical cylindrical portion configuration, as desired.

Bottom housing 40 also typically includes a hinged portion 44 that will selectively couple to top housing 20 such that it may be opened and more items, such as candy, may be easily placed within container 12. Although hinged portion 44 and top housing 20 are configured to couple via a friction or interference fit, other selectively coupling structures may be utilized, as desired.

With this configuration a user, such as a child, may easily open the bottom and easily insert more candy, then dispense the candy in a fun and entertaining way by rotating the faceplate and thereby causing the novelty portions to rotate also.

Faceplate 50 typically rotationally couples to top housing 20 via an overlapped fit, however, other rotationally coupling configurations may be utilized, as desired. All of the parts of system 10 are typically made from a plastic material, however other materials, such as rubber and other polymers, among others, may be utilized, as desired.

FIG. 3 shows another exploded view of the exemplary embodiment in FIG. 1, showing novelty portions 60, which typically have a gearing coupling portion 62 and a visual portion 61. Gearing coupling portion 62 is typically configured to extend through an aperture of gearing to expand on the other side to couple them together. However, other coupling structures and configurations may be utilized, as desired. Similarly, rotational gearing 74 couples to faceplate 50 in a similar way, but other rotationally coupling configurations may be utilized, as desired. Also shown is the underside of faceplate 50, showing one exemplary configuration for rotational gearing 74 and gearing 70. Gearing coupling portion 62 of novelty portion 60 is configured to couple to novelty gearing 70. Novelty gearing 70 is configured to rotationally couple to the top housing such that when faceplate 50 is rotated with respect to container 12 or top housing 20, novelty portions 60 rotate also.

Gearing coupling portion 62 is typically formed along with visual portion 61 in one piece, however, they may be configured to be coupled together in many ways, as desired.

Although visual portion 61 is shown as eyes, or the like, it will be appreciated that many other types of novelty portions may be utilized to add to the play value and entertainment of the system, as desired. Faceplate 50 is typically in the form of a face of a caricature, but it will be appreciated that many other configurations may be utilized to add entertainment value to the system, as desired. Integrated gearing 22 may be configured such that on the exterior of the container 12, such that the operation of the gearing will not be impeded or interfered with by the items to be dispensed by the system.

Figure 4A:
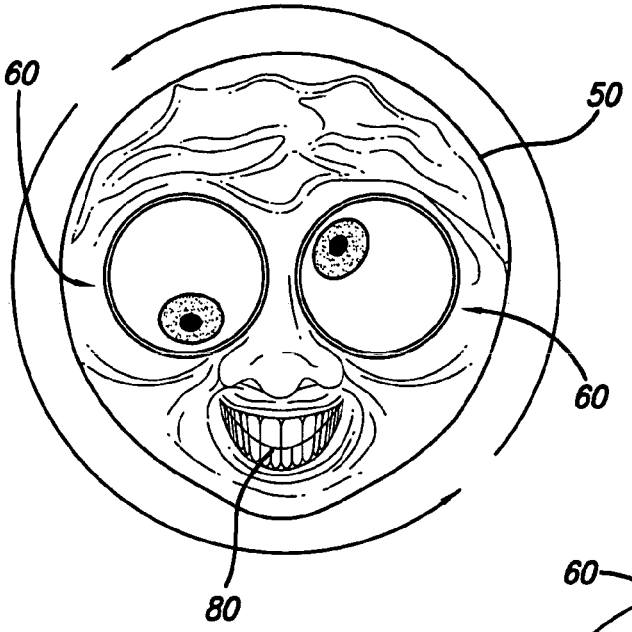
FIGS. 4*a–c* are top views of an exemplary embodiments showing various novelties.
Figure 4B:
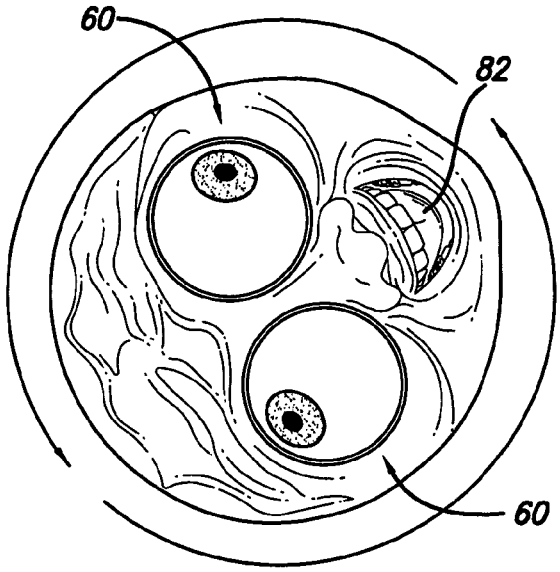
Figure 4C:
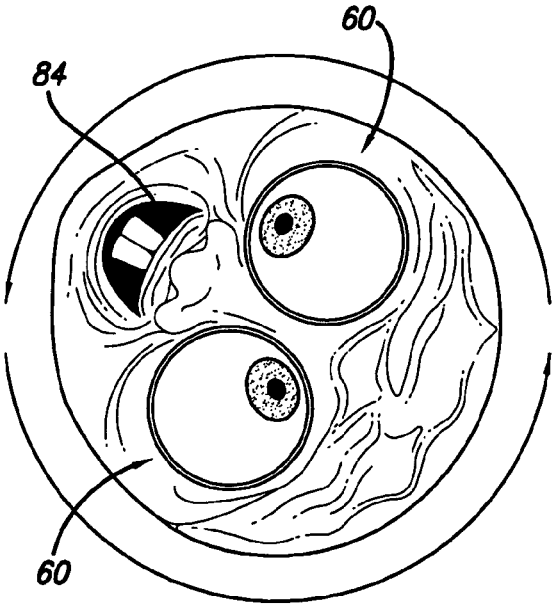

FIGS. 4*a–c* show the system in various rotational positions. Because faceplate 50 includes a dispensing aperture that may resemble the mouth of the caricature, top housing 20 may also include graphics 80, 82, and 84 between the dispensing orifices that may be visible when the dispensing aperture is aligned with them. This may make it appear as if the caricature's mouth is closed, open, having a full set of teeth, missing teeth, or many other configurations, as desired, to enhance play value and enjoyment of the system.

In closing, it is to be understood that the exemplary embodiments described herein are illustrative of the principles of the present invention. Other modifications that may be employed are within the scope of the invention. Thus, by way of example, but not of limitation, alternative configurations may be utilized in accordance with the teachings herein. Accordingly, the drawings and description are illustrative and not meant to be a limitation thereof.

What is claimed is:

1. A dispensing system comprising:

a top housing;

a bottom housing configured to couple to said top housing to form an enclosure there between;

a faceplate configured to rotationally couple to said top housing and dispense items from said enclosure;

at least one novelty portion adapted to move when said faceplate rotates with respect to said top housing; and gearing configured to rotationally couple said at least one novelty portion to said top housing.

2. The dispensing system of claim 1, wherein said gearing includes at least one gear configured to couple to said at least one novelty portion, said at least one coupled gear being rotationally coupled to said top housing portion.

3. The dispensing system of claim 2, wherein said at least one coupled gear is rotationally coupled to said top housing portion via at least one free-spinning gear.

4. A dispensing system, comprising:

a top housing;

a bottom housing configured to couple to said top housing to form an enclosure there between;

a faceplate configured to rotationally couple to said top housing and dispense items from said enclosure; and at least one novelty portion adapted to move when said faceplate rotates with respect to said top housing, wherein said top housing comprises:

integrated gearing configured to rotationally couple to said at least one novelty portion;

at least one dispensing aperture configured to allow items to pass there through;

faceplate coupling structure configured to rotationally couple to said faceplate; and bottom housing coupling structure.

5. The dispensing system of claim 4, wherein said top housing includes graphics in operational proximity to said at least one dispensing aperture.

6. A dispensing system, comprising:

a top housing;

a bottom housing configured to couple to said top housing to form an enclosure there between;

a faceplate configured to rotationally couple to said top housing and dispense items from said enclosure; and at least one novelty portion adapted to move when said faceplate rotates with respect to said top housing, wherein said bottom housing comprises:

top housing coupling structure; and a portion hingedly coupled to said top housing, said hingedly coupled portion adapted to open for placement of items in said enclosure.

7. A dispensing system, comprising:

a top housing;

a bottom housing configured to couple to said top housing to form an enclosure there between;

a faceplate configured to rotationally couple to said top housing and dispense items from said enclosure; and at least one novelty portion adapted to move when said faceplate rotates with respect to said top housing, said one novelty portion coupled to said eye-like portion including an eye-like portion and a gearing coupling portion.

8. A dispensing system, comprising:

a container configured to dispense items from at least one orifice;

a faceplate rotationally coupled to said container and including at least one aperture adapted to dispense items when aligned with said at least one orifice;

at least one novelty member coupled to said faceplate and configured to move when said faceplate rotates with respect to said container; and gearing configured to rotationally couple said at least one novelty member to said container.

9. The dispensing system of claim 8, wherein said container gearing comprises:

a peripheral container gear;

a first faceplate gear operatively coupled to said peripheral container gear; and a second faceplate gear operatively coupled to said peripheral container gear via a free-spinning gear.

10. A dispensing system, comprising:

a top housing including first gearing;

a bottom housing configured to couple to said top housing to form an enclosure there between;

a faceplate including at least one aperture adapted to dispense items from said enclosure, said faceplate configured to rotate relative to said top housing;

at least one novelty member operatively coupled to said faceplate; and second gearing configured to rotationally couple said at least one novelty member to said top housing via said first gearing.

11. The dispensing system of claim 10, wherein said bottom a housing includes a portion being hingedly coupled to said top housing.

* * * * *